US005520137A

United States Patent [19]

Arii et al.

[11] Patent Number: 5,520,137

[45] Date of Patent: May 28, 1996

[54] TWIN-HULL BOAT WITH HYDROFOILS

[75] Inventors: Toshihiko Arii, Ibaraki; Kensaku Takenaka, Osaka; Yoshitada Hiramatsu, Kishiwada; Masayuki Segawa, Nara-ken; Hiromasa Sugimura, Otsu; Ryohei Takeuchi, Suita; Kazuya Hatta, Kawachinagano; Katsuaki Fujiya, Takarazuka; Yasuo Nakai, Katano, all of Japan

[73] Assignee: Hitachi Zosen Corporation, Osaka, Japan

[21] Appl. No.: 430,148

[22] Filed: Apr. 26, 1995

Related U.S. Application Data

[63] Continuation of Ser. No. 204,550, Mar. 2, 1994, abandoned.

[30] Foreign Application Priority Data

| | | | |
|---|---|---|---|
| Mar. 12, 1993 | [JP] | Japan | 5-051984 |
| Mar. 12, 1993 | [JP] | Japan | 5-051985 |
| May 24, 1993 | [JP] | Japan | 5-120302 |

[51] Int. Cl.[6] ..... B63B 1/28

[52] U.S. Cl. ..... 114/280; 114/274

[58] Field of Search ..... 114/274, 280, 114/283, 275, 282, 67 A

[56] References Cited

U.S. PATENT DOCUMENTS

| | | | |
|---|---|---|---|
| 2,341,159 | 2/1944 | Neklutin | 114/274 |
| 2,703,063 | 3/1955 | Gilruth | 114/280 |
| 2,791,195 | 5/1957 | Almqvist et al. | 114/20 |
| 3,137,260 | 6/1964 | Harris, Jr. et al. | 114/275 |
| 3,141,436 | 7/1964 | Cathers et al. | 114/67 A |
| 3,469,550 | 9/1969 | Priestley | 114/275 |
| 3,598,076 | 8/1971 | Saxton | 114/274 |
| 3,604,384 | 9/1971 | Coles | 114/274 |
| 3,709,180 | 1/1973 | Kobylinski et al. | 114/274 |
| 3,812,806 | 5/1974 | Korotkov et al. | 114/280 |
| 3,968,762 | 7/1976 | Meyer, Jr. | 114/282 |
| 4,606,291 | 8/1986 | Hoppe et al. | 114/274 |
| 4,665,853 | 5/1987 | Gerdsen et al. | 114/280 X |

FOREIGN PATENT DOCUMENTS

| | | | |
|---|---|---|---|
| 831681 | 11/1937 | France . | |
| 1039868 | 11/1954 | Germany . | |
| 1266163 | 10/1965 | Germany . | |
| 0668936 | 10/1964 | Italy | 114/294 |
| 56-099871 | 8/1981 | Japan . | |
| 0249792 | 10/1990 | Japan | 114/274 |
| 1319945 | 4/1971 | United Kingdom . | |
| 1524938 | 8/1977 | United Kingdom . | |

*Primary Examiner*—Sherman Basinger

*Attorney, Agent, or Firm*—Barnes, Kisselle, Raisch, Choate, Whittemore & Hulbert

[57] ABSTRACT

A twin-hull boat equipped with a pair of transverse hydrofoils 4 and 5 which are respectively secured to the bottom surface of twin-hull structures 3A and 3B adjacent the stem and stern. A pair of auxiliary wings 6A and 6B are installed opposite to each other at predetermined positions on the internal wall surfaces of the twin-hull structures 3A and 3B mutually facing the hull center line and at a predetermined height between the upper water line formed in the course of low-speed cruising and the lower water line formed in the course of high-speed cruising. The twin-hull boat incorporates a postural angle regulating device 15 to properly regulate the postural angle of the auxiliary wings 6A and 6B by causing them to pivot about a horizontal axis.

1 Claim, 13 Drawing Sheets

TWIN-HULL BOAT WITH HYDROFOILS

FIELD OF THE INVENTION

This is a continuation of application Ser. No. 08/204,550 filed on Mar. 2, 1994 and now abandoned.

The present invention relates to a twin-hull boat which is equipped with a plurality of hydrofoils across a twin hull and capable of cruising at a high speed.

BACKGROUND OF THE INVENTION

Today, conventional twin-hull boats with hydrofoils are transversely equipped with a plurality of hydrofoils below the bottom of the stem and the stern extending across a twin hull.

In the course of securing a plurality of hydrofoils to the bottom of the stem and the stern of a twin-hull, predetermined hydrofoils are provisionally secured to the bottom of the completed twin hull and trial runs are executed by cruising the boat in this condition. Finally, based on the result of these trial runs, the optimal angle for securing hydrofoils to the twin-hull boat is eventually determined.

Nevertheless, in the case of the conventional twin-hull boat with hydrofoils cited above, since the optimal angle for securing hydrofoils to the twin-hull is determined in the final stage in order that the angle can be suited for cruising the boat at a very high speed, the determined angle cannot be optimal in the transitional period from the time in which hydrofoils remain still to the time at which the twin-hull boat starts to cruise with the hydrofoils afloat on the water surface.

Therefore, any conventional twin-hull boat with hydrofoils in service today necessarily spends much time in the transitional period before actually starting to cruise with the hydrofoils afloat on the water surface.

Even though there is a known twin-hull boat based on a system for swinging hydrofoils in order to vary the postural position of the hydrofoils, this in turn requires installation of a special device in limited space on the hull to permit swinging of the hydrofoils, and also involves much difficulty to install the device therein. In addition, total cost for manufacturing the twin-hull boat incorporating this system is quite high.

DISCLOSURE OF THE INVENTION

Therefore, a primary object of the invention is to provide a novel twin-hull boat which is equipped with a plurality of hydrofoils and capable of effectively exerting a floating function in accordance with the actual cruising condition despite of own simple structure.

To achieve the above object, as an important aspect of the invention, according to the novel twin-hull boat equipped with a plurality of hydrofoils which are transversely disposed across both-side hulls below the stem and the stern, a pair of auxiliary wings are independently secured at least to either the internal wall on opposite sides of the center line of the twin hulls or the external wall thereof at a predetermined position between the upper water line formed in the course of cruising the boat at a low speed and the lower water line formed in the course of cruising it at a very high speed. In association with the auxiliary wings, a wing postural angle regulating device is provided, which properly regulates the postural angle of these auxiliary wings by causing them to individually pivot on a horizontal axis.

According to the structure of the first embodiment of the invention, since the novel twin-hull boat with hydrofoils according to the invention is provided with at least a pair of auxiliary wings respectively being capable of varying their postural angle by operating the wing-postural angle regulating device, the twin-hull boat can quickly be lifted above the water surface in a short period of time before starting to cruise at a very high speed.

Unlike hydrofoils, since the auxiliary wings are constantly held above the water surface, wave resistance is minimized, and yet, visual surveillance of the auxiliary wings can easily be made.

By virtue of the provision of the novel auxiliary wings according to the invention, the twin-hull boat related to the invention dispenses with the conventional device for adjusting the angle for securing hydrofoils to the bottom of the stem and the stern, thus resulting in a simplified structure.

As another important aspect of the invention, according to the novel twin-hull boat equipped with hydrofoils, the front hydrofoil on the part of the stem is V-shaped, whereas the rear hydrofoil on the part of the stern is linearly structured and disposed horizontally. A pair of auxiliary wings are disposed in local domains close to both ends of the front and rear hydrofoils, where the auxiliary wings are driven to swing independently of the corresponding hydrofoils.

According to the structure of the second embodiment of the invention, since a pair of hydrofoils disposed across the twin hulls are respectively provided with an auxiliary wing, by causing the auxiliary wings to swing themselves during the transitional period from the time in which the boat cruises at a low speed to the time at which the boat starts to cruise at a high speed, the twin-hull boat can assume an optimal posture in order to minimize the time needed for floating above the water surface.

In addition, by virtue of mechanism to cause the auxiliary wings to independently swing themselves, rolling and pitching effect adversely affecting the twin-hull boat in the course of high-speed cruising can be minimized.

As another important aspect of the invention, according to the novel twin-hull boat equipped with hydrofoils related to the invention, fin units are provided in the longitudinal direction below the bottom surface of the rear hydrofoil disposed on the part of the stern by way of traversing the twin hull.

According to the structure of the third embodiment of the invention, fins are provided in the longitudinal direction below the bottom surface of the rear hydrofoil disposed on the part of the stern across the twin hull. Owing to this arrangement, the novel twin-hull boat equipped with hydrofoils can securely prevent the twin hull from drifting transversely even when being hit by beam wind or beam waves while cruising at a fast speed, thus achieving reliable stability in the course of high-speed cruising.

A variety of advantageous features and effects of the invention will more fully be clarified from the detailed description rendered in association with the accompanying drawings that follow.

DESCRIPTION OF THE PREFERRED EMBODIMENTS

Referring now to FIGS. 1 through 5, structural detail of a novel twin-hull boat equipped with a pair of hydrofoils according to the first embodiment of the invention is described below.

Figure 1:
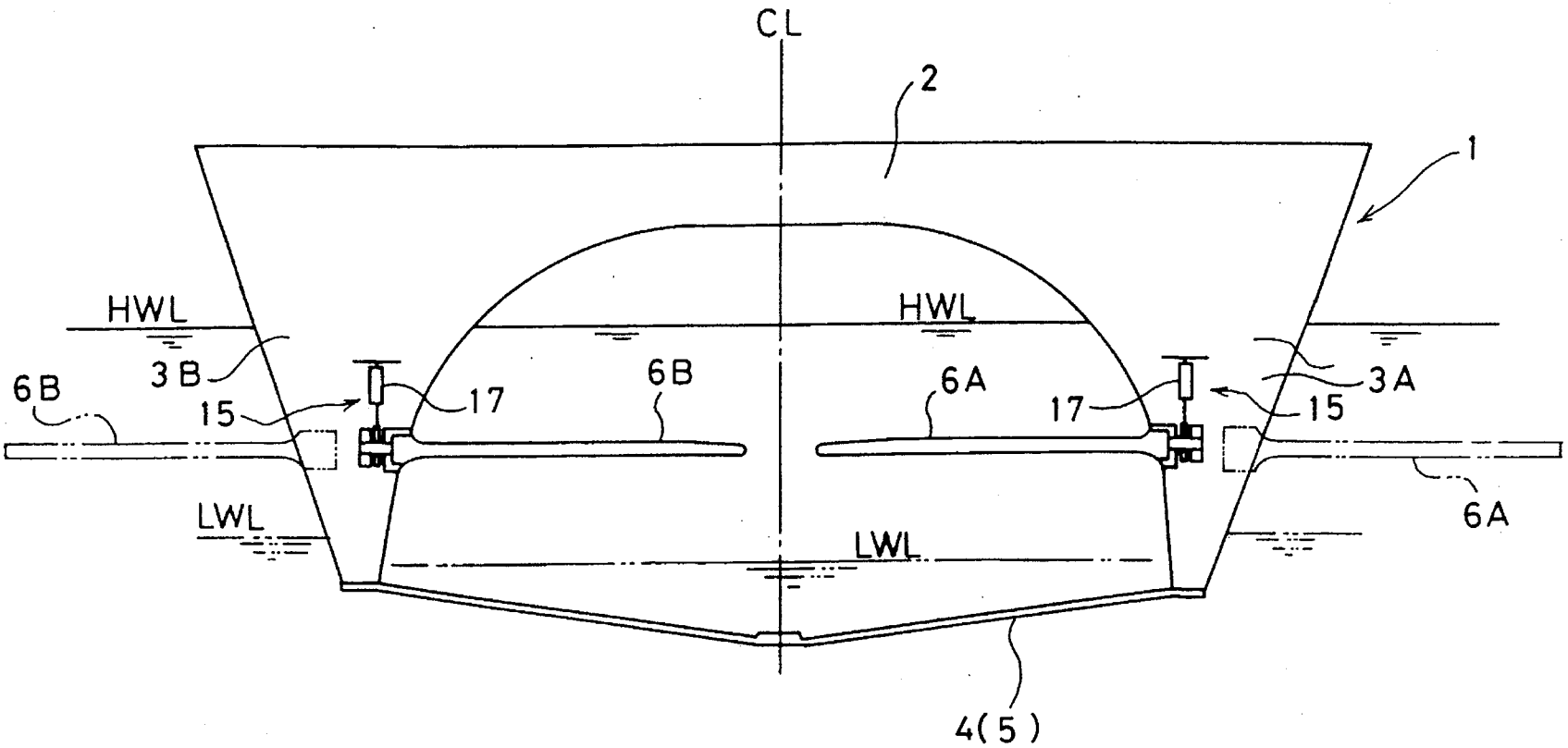
FIG. 1 is a cross-sectional view of the twin-hull boat provided with hydrofoils according to the first embodiment of the invention.
Figure 2:
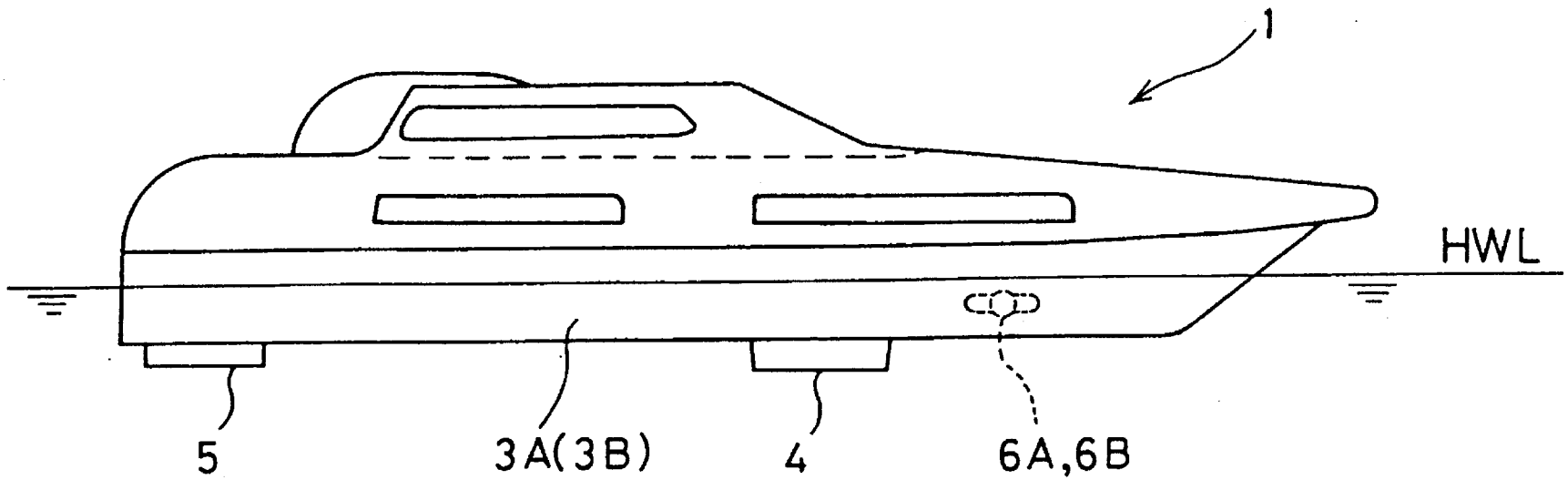
FIG. 2 is a lateral view of the twin-hull boat according to the first embodiment of the invention.

The reference numeral 1 shown in FIGS. 1 and 2 designates a twin hull of the twin-hull boat equipped with a pair of hydrofoils according to the first embodiment of the invention.

A pair of twin-hull structures 3A and 3B are disposed on both sides of the main hull structure 2 furnished with a deck on the top surface.

In order to securely sustain the twin hull 1 afloat while the twin-hull boat cruises at a high speed, a pair of hydrofoils consisting of a stem-side hydrofoil 4 and another stern-side hydrofoil 5 are transversely secured to the bottom of the twin-hull across the twin-hull structures 3A and 3B.

A pair of auxiliary wings (or called floating blades) 6A and 6B are respectively secured to the internal wall domains of the twin-hull structures 3A and 3B forwardly of the front hydrofoil 4 and projecting horizontally and facing the center line CL of the twin hull 1.

The auxiliary wings 6A and 6B are provided in order to act during the transitional period needed for accelerating the twin-hull boat 1 to cruise at a high speed above the water surface from the initial rise-up posture cruising at a low speed. The auxiliary wings 6A and 6B are respectively disposed at a position below the high water line HWL formed in the course of cruising the twin-hull boat 1 at a low speed and the lower water line LWL formed in the course of cruising the boat 1 at a high speed so that these auxiliary wings 6A and 6B can fully be submerged in the water while the twin-hull boat 1 cruises at a low speed, and yet, the auxiliary wings 6A and 6B can externally be exposed above the water surface while the twin-hull boat 1 cruises at a very high speed.

Figure 3:
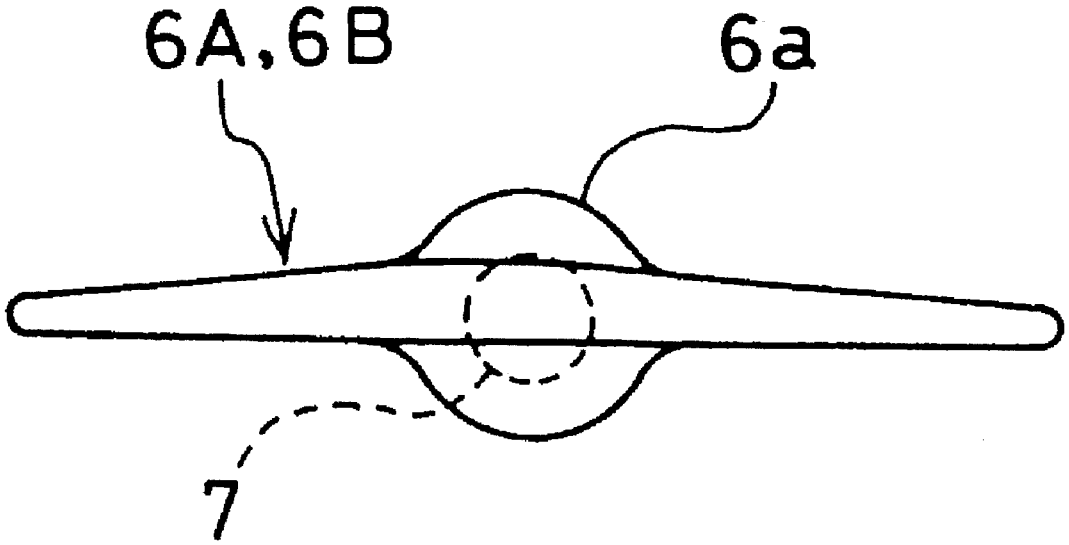
FIG. 3 is a front view of one of a pair of auxiliary wings provided for the twin-hull boat according to the first embodiment of the invention.

As shown in FIG. 3, the auxiliary wings 6A and 6B are respectively wing-shaped in section. As shown in the plan of FIG. 5, the auxiliary wings 6A and 6B are of rectangular shape.

Figure 4:
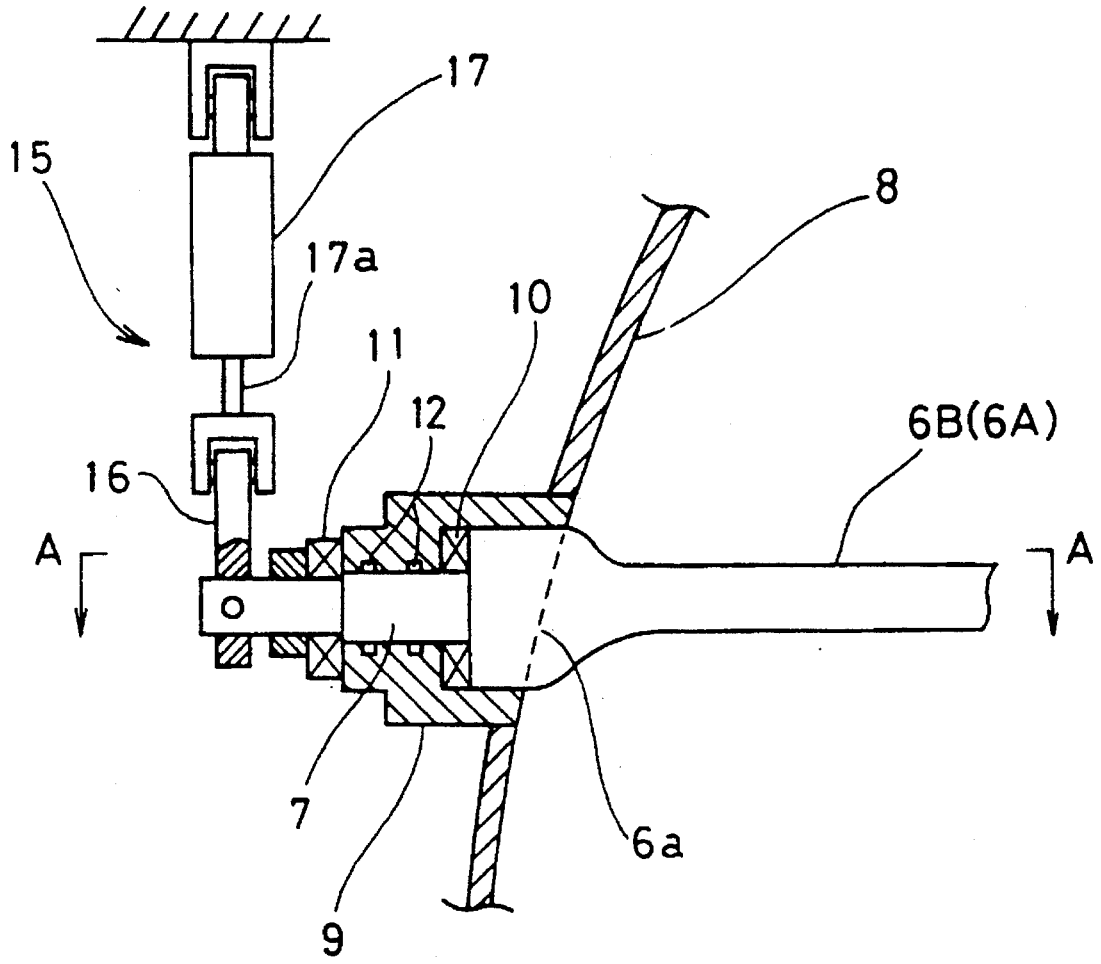
FIG. 4 is a cross-sectional view of fundamental components of a drive mechanism provided for each of the auxiliary wings according to the first embodiment of the invention.
Figure 5:
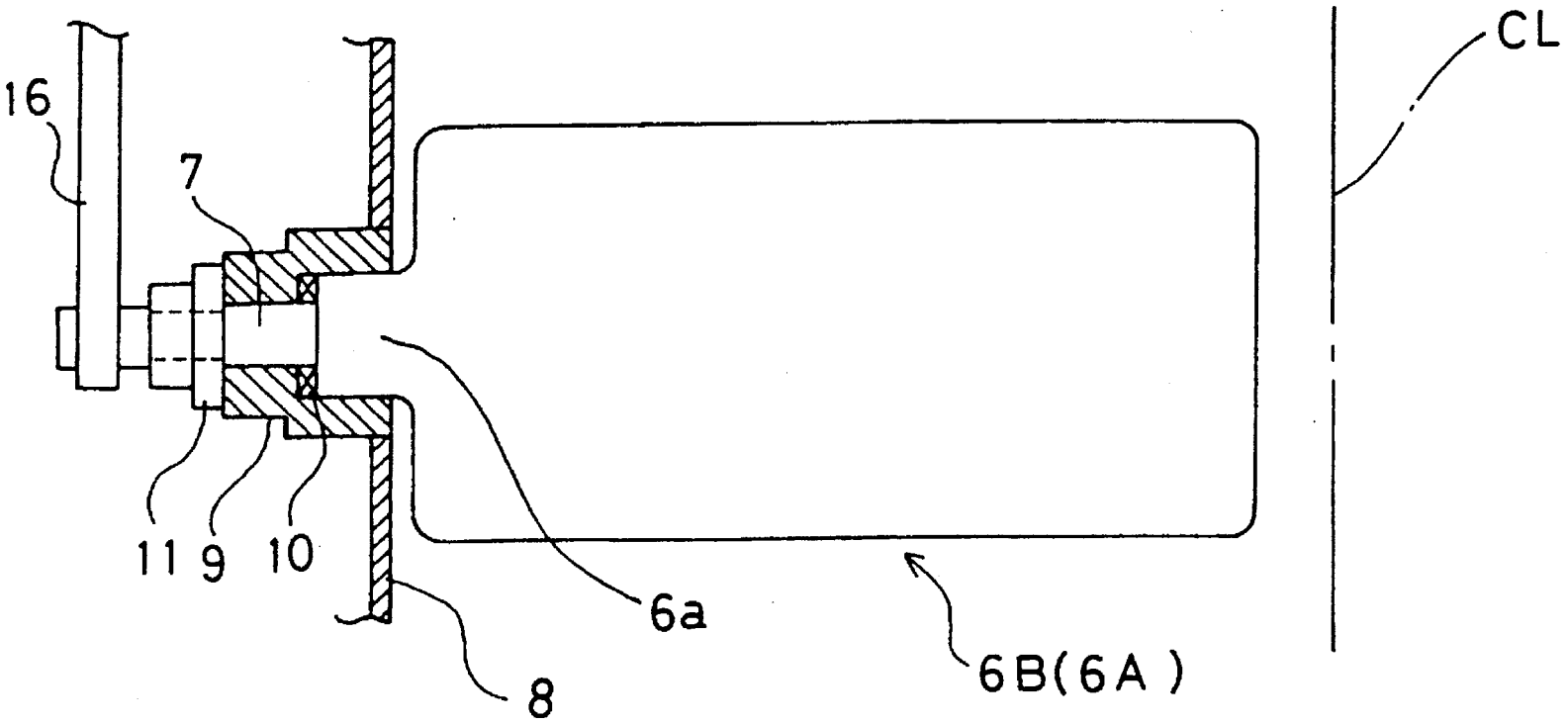
FIG. 5 is a cross-sectional view of the drive mechanism provided for each auxiliary wing taken on line A—A shown in FIG. 4.

As shown in FIGS. 4 and 5, each of the auxiliary wings 6A and 6B is rotatably secured to a bearing case 9 which is integrated with an external hull plate 8 (constituting the internal wall of the twin hull structures 3A and 3B) by a bearing 10, a supporting boss 6*a*, and a shaft member 7 projecting outwardly from the base of the boss 6*a*.

The reference numeral 11 shown in FIG. 4 designates a bearing unit, whereas the reference numeral 12 designates a plurality of sealing members such as O-rings for example.

A postural angle regulating device 15 is secured to an end of the shaft member 7 in order to properly regulate the postural angle of the auxiliary wings 6A and 6B.

More particularly, the postural angle regulating device 15 consists of a lever member 16 having an end linked with the tip of the shaft member 7 and a cylinder unit 17 such as an oil-pressurized cylinder for example linked with the other end of the lever member 16. The lever member 16 is linked with a rod member 17*a* of the cylinder unit 17. The cylinder unit 17 incorporates a stroke sensor for detecting the amount of projection of the rod member 17*a*.

According to the structural arrangement described above, simultaneous with the shift from the low-speed cruising mode to the high-speed cruising mode, postural angles of the auxiliary wings 6A and 6B are properly regulated by the cylinder 17 in accordance with actual cruising speed of the twin-hull boat 1.

By implementing the adjustment of the postural angles of those auxiliary wings 6A and 6B, the twin-hull boat 1 can act during the transitional period ranging from the time for lifting the twin-hull 1 above the water surface to the time at which the twin-hull boat 1 starts to cruise at a high speed. In other words, the twin-hull boat 1 can efficiently cruise itself.

Furthermore, since the auxiliary wings 6A and 6B are respectively secured to specific positions higher than the bottom of the twin-hull structures 3A and 3B, in contrast with hydrofoils 4 and 5 which are respectively secured to narrow space of the bottom domain, the auxiliary wings 6A and 6B can easily be secured to the predetermined positions.

Furthermore, since the auxiliary wings 6A and 6B are respectively exposed above the water surface while the twin-hull boat 1 cruises at a high speed, the physical condition of the auxiliary wings 6A and 6B can be checked via visual inspection to facilitate maintenance and inspection work.

Furthermore, unlike any conventional twin-hull boat requiring adjustment of the angles of the installed hydrofoils whenever the boat cruises above the water surface, the novel twin-hull boat 1 according to the invention dispenses with such a device otherwise needed for adjusting angles of the installed hydrofoils, thus resulting in reduced cost.

When implementing the first embodiment, the auxiliary wings 6A and 6B are secured to internal walls of the twin-hull structures 3A and 3B so as to project inwardly facing the hull center line CL. However, as indicated by double-dotted imaginary lines shown in FIG. 1, the auxiliary wings 6A and 6B may also project outwardly from the external walls of the twin-hull structures 3A and 3B. Depending on circumstances, it is also possible for the twin hull boat of the invention to provide two pairs of auxiliary wings 6A and 6B on both the internal and external walls of the twin-hull structures 3A and 3B projecting horizontally inwardly and outwardly.

Next, referring to FIGS. 6 through 12, another structural feature of the novel twin-hull boat according to the second embodiment of the invention is described below.

Figure 6:
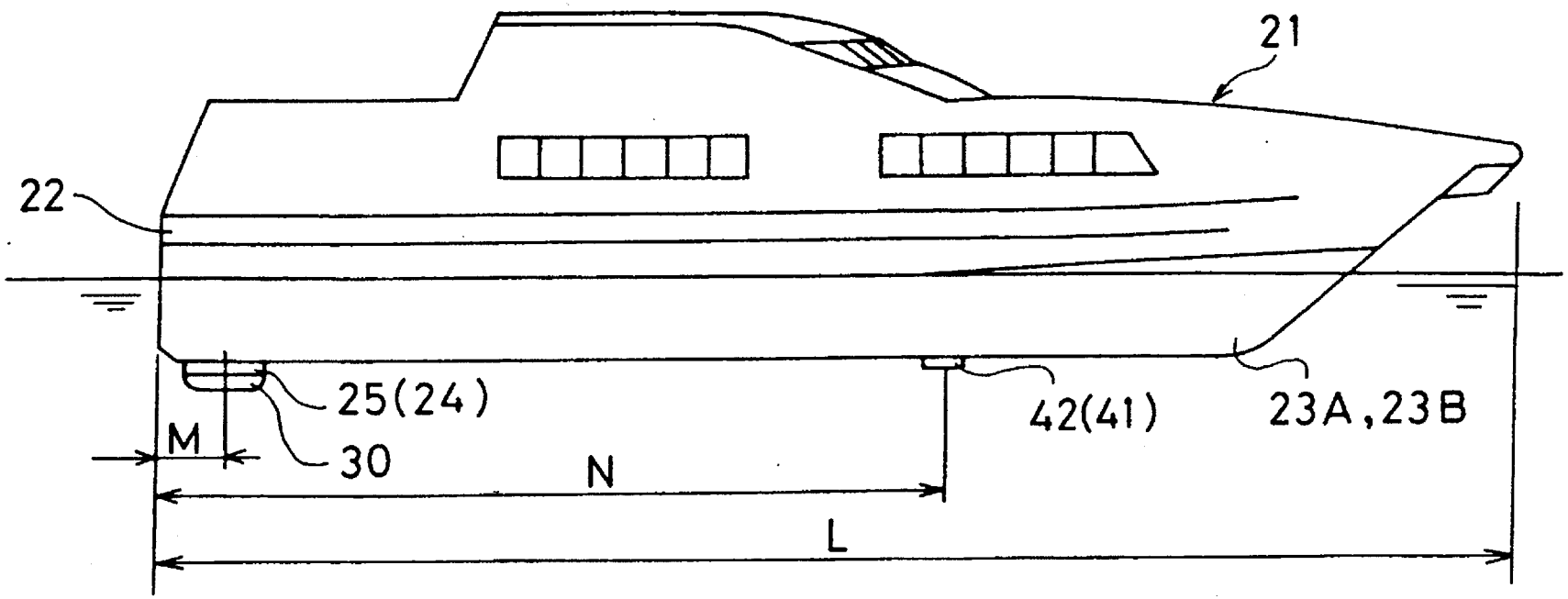
FIG. 6 is a lateral view of the twin-hull boat provided with hydrofoils according to the second embodiment of the invention.
Figure 7:
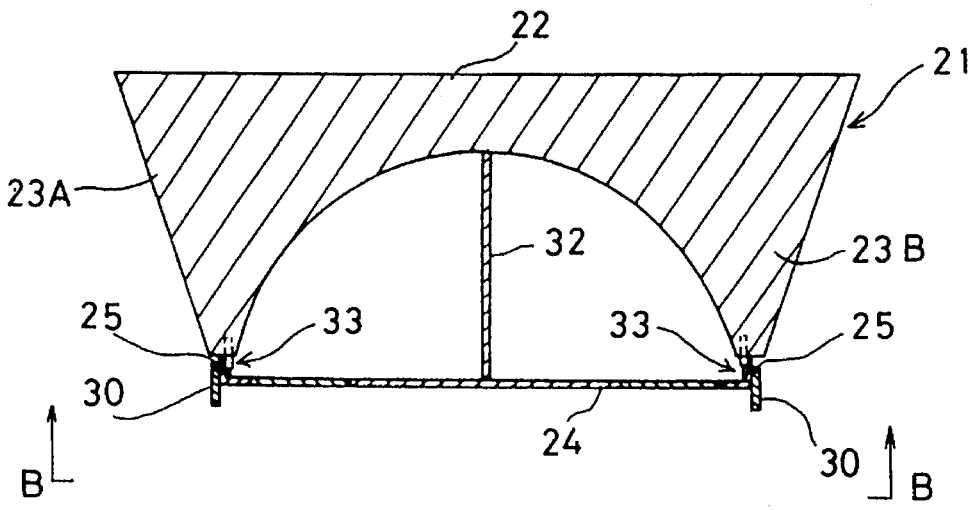
FIG. 7 is a cross-sectional view of the rear hydrofoil on the part of the stern according to the second embodiment of the invention.
Figure 8:
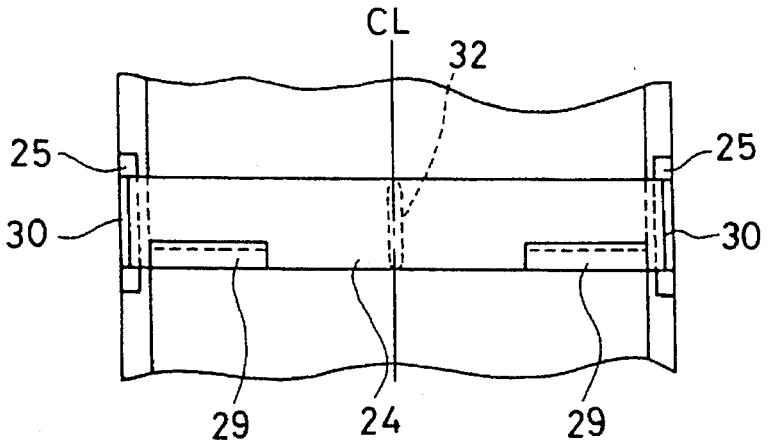
FIG. 8 is a plan of the rear hydrofoil corresponding to a range indicated by arrowed lines B—B shown in FIG. 7.

The reference numeral 21 shown in FIG. 6 designates a twin hull of the twin-hull boat equipped with a pair of hydrofoils, where twin-hull structures 23A and 23B are provided on both sides of the main hull structure mounting deck thereon.

As shown in FIGS. 7 through 11, a pair of rear mounts 25 for securing a stern-side hydrofoil 24 are respectively set to the bottom of each keel 23*a* of the twin-hull structures 23A and 23B, the distance M being substantially 5% of the total length L between the stem and the stern of the twin hull 21.

More particularly, the center of each of the rear mounts 25 is set in order that (M/L) can be within substantially 5%.

Figure 10:
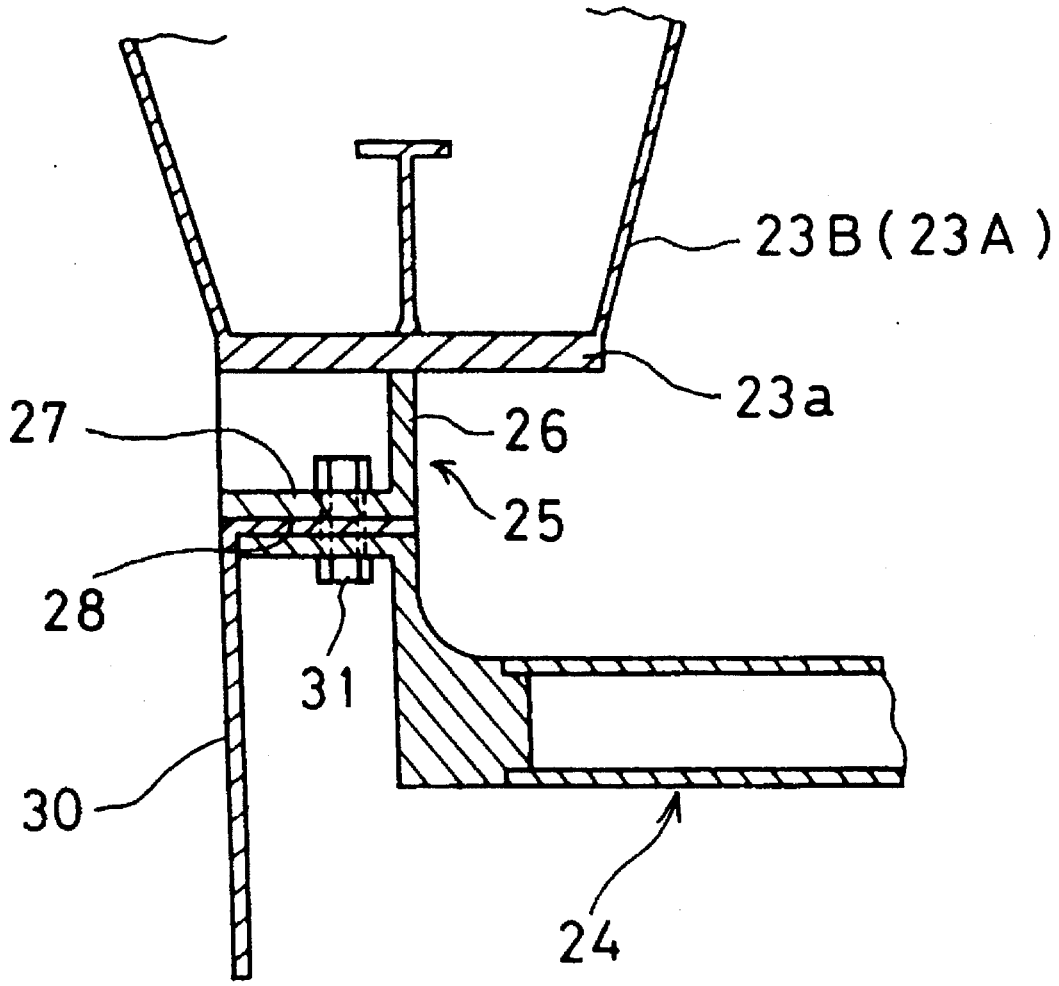
FIG. 10 is a cross-sectional view of the components of the rear hydrofoil taken on line C—C shown in FIG. 9.

As shown in FIG. 10, each of the rear mounts 25 consists of a perpendicular member 26 secured to the bottom surface of the keel 23*a* of the twin-hull structure 23A and 23B and a horizontal member 27 which is horizontally linked with the bottom surface of the perpendicular member 26. The bottom surface of the horizontal member 27 makes up a junction surface 28 having curvature in the longitudinal direction.

The stern-side hydrofoil 24 is horizontally secured to the rear mounts 25 and fully submergible in water. A pair of auxiliary wings 29 are respectively secured in trailing edge positions close to both edges of the stern-side hydrofoil 24, and the auxiliary wings 29 are swingably driven independent of the hydrofoil 24.

A pair of fin units (these may be called skegs) 30 are respectively secured to both edges of the stern-side hydrofoil 24. As is used for making hydrofoils, high-tensile steel plates are used for making the fin units 30. The fin units 30 are thinly structured to minimize their weight.

The stern-side hydrofoil 24 and the fin units 30 are respectively secured to the bottom of the junction surface 28 of the rear mounts 25 on both sides by means of bolt 31. The center of the stern-side hydrofoil 24 is supported by a strut 32 vertically projected from the bottom center line CL of the main hull 22.

Figure 9:
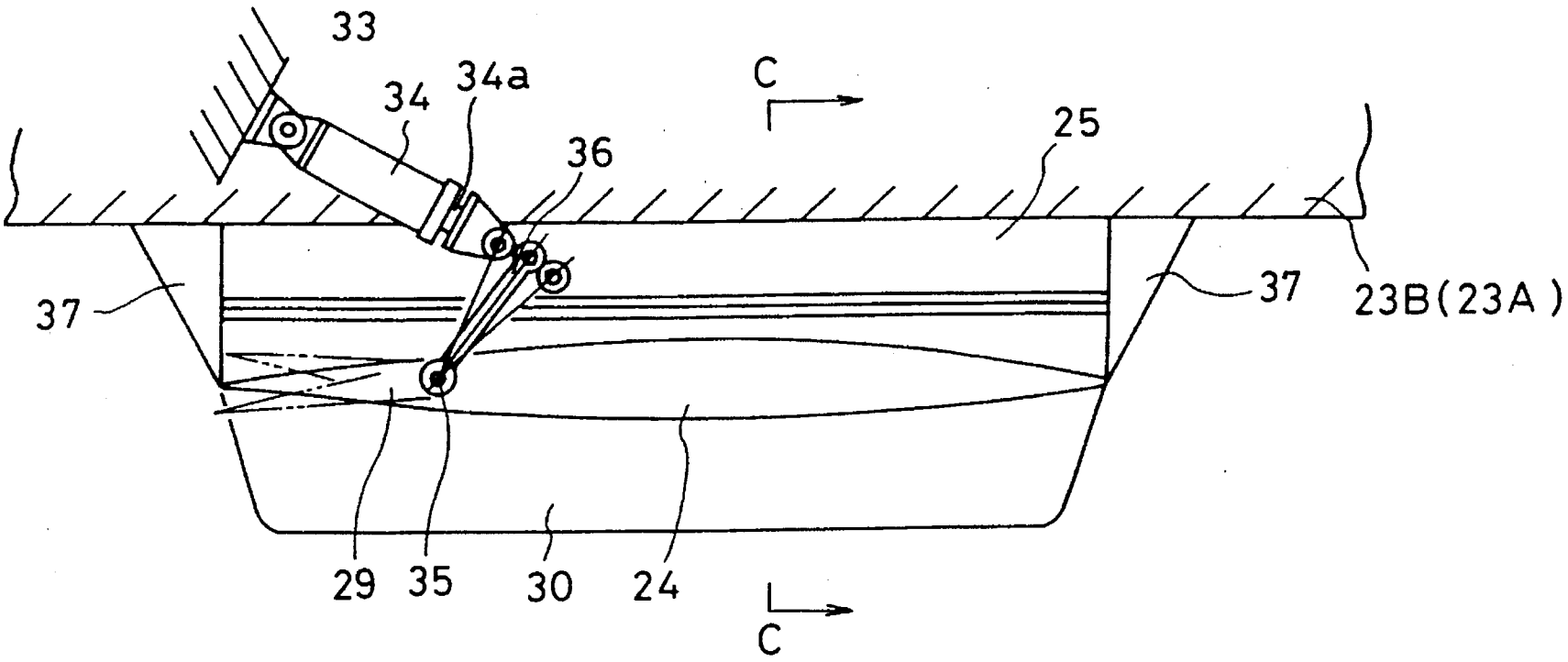
FIG. 9 is a cross-sectional view of fundamental components of the rear hydrofoil on the part of the stern according to the second embodiment of the invention.

As shown in FIG. 9, a drive unit 33 for swingably operating the auxiliary wings 29 consists of a wing-control cylinder 34 such as an oil-pressurized cylinder which is disposed inside of the bottom domain of the twin-hull structures 23A and 23B. The tip of a rod member 34*a* of the wing-control cylinder 34 is linked with a rotary shaft 35 for supporting each of the auxiliary wings 29 by a lever unit 36. In association with the reciprocation of the rod member 34*a* of the wing-control cylinder 34, the auxiliary wings 29 swing vertically. The reference numeral 37 designates a body making the water flow smooth.

Figure 11:
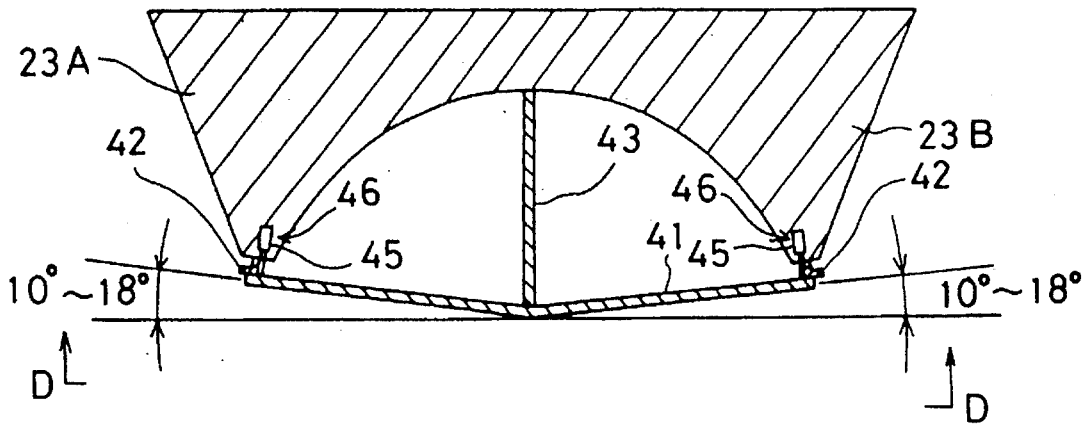
FIG. 11 is a cross-sectional view of the front hydrofoil on the part of the stem according to the second embodiment of the invention.
Figure 12:
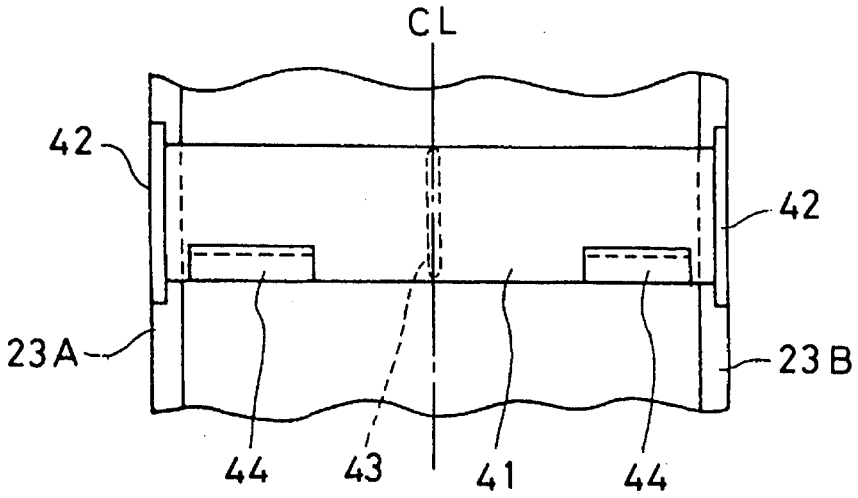
FIG. 12 is a plan of the front hydrofoil corresponding to a range indicated by arrowed lines D—D shown in FIG. 11.

As shown in FIGS. 6, 11, and 12, a pair of front mounts 42 for securing a stem-side hydrofoil 41 is set to the bottom of each keel 23*a* of the twin-hull structures 23A and 23B, the distance N being substantially 60 through 70% of the total length L in the longitudinal direction of the twin hull 21.

More particularly, the center of each of the front mounts 42 is set in order that (N/L) can be within substantially 60 through 70%. Structurally, the front mounts 42 are identical to the rear mounts 25.

The stem-side hydrofoil 41 is V-shaped and fully submergible in water, and is secured to the junction surfaces of the front mounts 42 by bolts.

The center of the stem-side hydrofoil 41 is supported by a strut 43 vertically projected from the bottom center line CL of the hull 21.

The fully submergible stem-side hydrofoil 41 has upwardly inclined angles on both sides in a range from 10 degrees to 18 degrees. A pair of auxiliary wings 44 and 44 having structure identical to that of the auxiliary wings 29 of the stern-side hydrofoil 24 are secured in trailing edge positions close to both edges of the stern-side hydrofoil 41 and are disposed on the part of the stern. The auxiliary wings 44 and 44 are respectively driven by a drive unit 46 incorporating a cylinder unit 45 so that they can swing vertically.

While the twin-hull boat 21 cruises, the stem portion is lifted above the water surface by the functional effect of the stem-side hydrofoil 41 without causing the twin-hull 21 to fully become afloat. On the other hand, by the functional effect of the stern-side hydrofoil 24, the stern portion is lifted to a condition in which the bottom remains submerged. In other words, the stem portion is afloat above the water surface, but the stern portion remains submerged.

Since the stem-side hydrofoil 41 and the stern-side hydrofoil 24 are respectively equipped with swingable auxiliary wings 29/29 and 44/44, when the low-speed cruising mode is shifted to the high-speed cruising mode, the swing angle (i.e., postural angle) of the auxiliary wings 29/29 and 44/44 can properly be adjusted in accordance with the actual cruising speed by operation of the cylinder units 34 and 45 provided for the drive units 33 and 46.

By virtue of the adjustment of the postural angle of those auxiliary wings 29/44, the transitional time from the floating to the activation of high-speed cruising of the twin-hull boat 21 can securely be achieved. This means that the twin-hull boat 21 can cruise with high efficiency.

While the twin-hull boat 21 embodied by the invention cruises under normal speed, the twin-hull 21 is prevented from fully becoming afloat above the water surface. In other words, the twin-hull boat 21 cruises by way of sustaining the stem-side hydrofoil 41 in the submerged condition, and therefore, the stem-side hydrofoil 41 is free from being exposed to beam waves, thus making it possible for the inventive twin-hull boat 21 to cruise in a constantly stabilized condition.

Furthermore, since the fully submergible stem-side hydrofoil 41 is secured to a forward position corresponding to about 60 through 70% of total hull length from the stern edge, and yet, since the fully submergible stern-side hydrofoil 24 is secured to a forward position from the stern edge by a distance corresponding to a maximum of 5% of total hull length, the weight of the twin-hull 21 is properly distributed to promote stability of the hull 21.

Since the stem-side and stern-side hydrofoils 24 and 41 are respectively secured across the twin-hull structures 23A and 23B without significantly projecting from the keels 23*a*, resistance generated by the twin-hull 21 during high-speed cruising is minimized. Mooring convenience is also promoted.

The stem-side and stern-side hydrofoils 24 and 41 are solidly secured to the twin-hull structures 23A and 23B, and yet, the center positions of the hydrofoils 24 and 41 are solidly supported by the corresponding struts 32 and 43, thus resulting in the reinforced strength of the hydrofoils 24 and 41. This in turn results in the reduced weight of the hydrofoils 24 and 41.

In addition, since the auxiliary wings 29/29 and 44/44 are independently driven to swing themselves, rolling and pitching during high-speed cruising can effectively be minimized.

Furthermore, by virtue of the provision of the fin units 30 for the stem-side hydrofoil 24, even when exposed to beam wind or beam waves during high-speed cruising, the twin-hull 21 can securely be prevented from being drifted aside, thus promoting stability and cruising comfort.

Furthermore, owing to the above structural arrangement, the twin-hull boat 21 according to the invention minimizes the generation of waves during towing and suppresses pitching behavior caused by head seas.

Next, referring to FIGS. 13 through 17, structural features of the novel twin-hull boat according to the third embodiment of the invention are described below.

Figure 13:
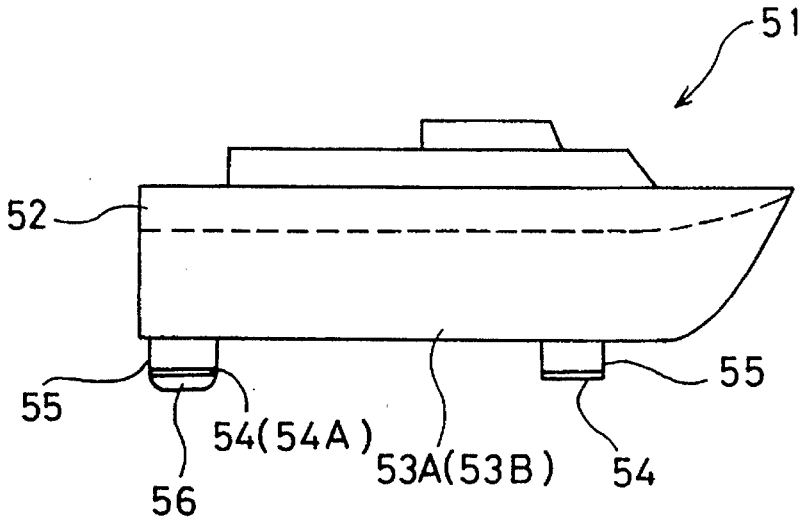
FIG. 13 is a lateral view of the twin-hull boat provided with hydrofoils according to the third embodiment of the invention.
Figure 14:
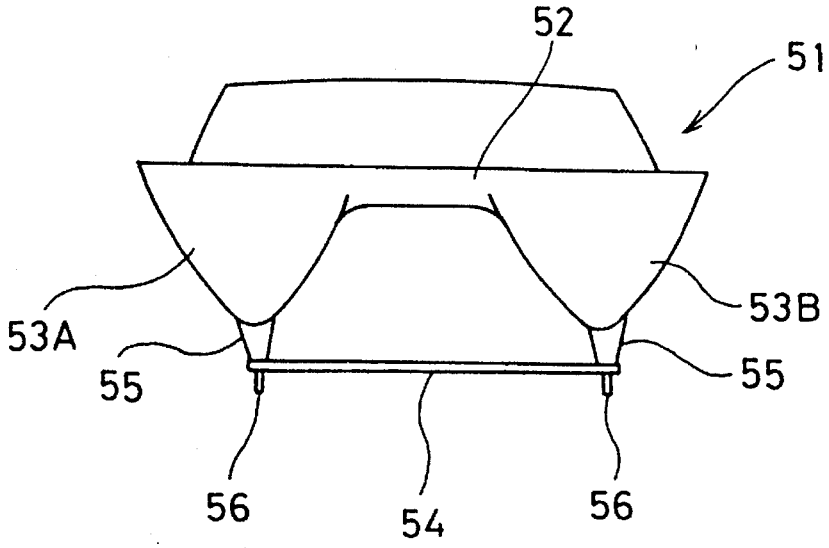
FIG. 14 is a front view of the twin-hull boat provided with hydrofoils according to the third embodiment of the invention.

The reference numeral 51 shown in FIGS. 13 and 14 designates a twin-hull of the twin-hull boat equipped with hydrofoils according to the third embodiment of the invention. Twin-hull structures 53A and 53B are provided on both sides of the main hull 52 mounting deck thereon.

A stem-side hydrofoil 54 and a stern-side hydrofoil 54A used for floating the twin hull 51 in the course of high-speed cruising are respectively secured across bottom domains of the twin-hull structures 53A and 53B on the part of the stem and the stern by corresponding struts 55.

A pair of fin units (often called skegs) 56 each having a predetermined height are respectively secured to both-side edges of the bottom surface of the stern-side hydrofoil 54A in the longitudinal direction. Each of the fin units 56 has a specific length equal to the distance (chord length) between the leading edge and the trailing edge of the stern-side hydrofoil 54A for example. As is used for making the hydrofoils 54 and 54A, high-tensile-steel plates are used for making the fin units 56. The fin units 56 are thinly composed to minimize weight.

Figure 15:
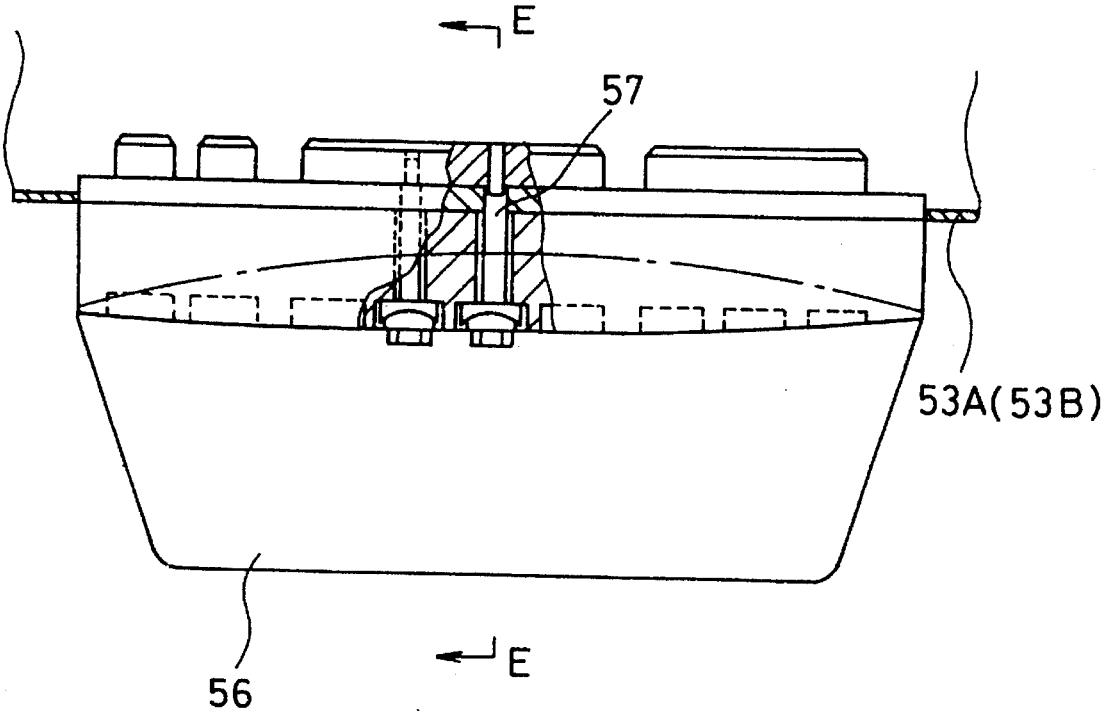
FIG. 15 is a lateral view of a fin unit provided for the third embodiment of the invention.
Figure 16:
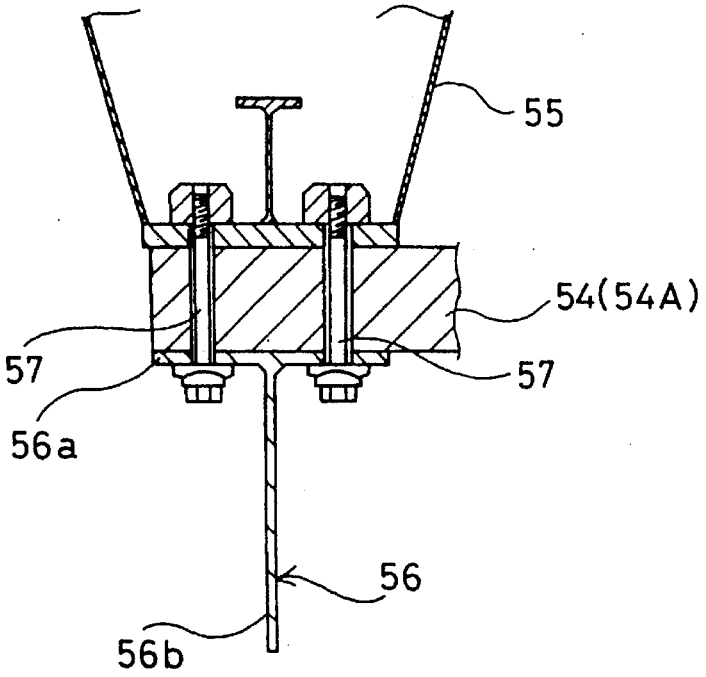
FIG. 16 is a cross-sectional view of the fin unit taken on line E—E shown in FIG. 15.

As shown in FIGS. 15 and 16, the fin units 56 are integrally combined with the stern-side hydrofoil 54A by means of a pair of bolts 57 respectively securing both edges of the stern-side-hydrofoil 54A to the corresponding struts 55. More particularly, a fixing flange 56*a* of each fin unit 56 is secured to the bottom surface at an edge of the hydrofoil 54A by the bolts 57 used for securing the hydrofoil 54A. The main fin unit 56*b* extends perpendicularly from the center of the fixing flange 56*a*.

Therefore, by virtue of the structural arrangement described above, even when the twin-hull boat 51 is exposed to beam wind or beam waves when cruising at a high speed, owing to the provision of the fin units 56 secured below the bottom surface of the stern-side hydrofoil 54A at both-side edges, the twin-hull boat 51 according to the invention can securely be prevented from drifting aside.

Furthermore, since the fin units 56 are secured to the stern-side hydrofoil 54A, the fin units 56 can submerge themselves in water more deeply than if secured to the stem-side hydrofoil 54, and therefore, the twin-hull boat 51 can be prevented from meandering during high-speed cruising.

In addition, since the fin units 56 are secured to the twin-hull 51 via the hydrofoil 54A by means of bolts 57, maintenance and inspection can be carried out very easily against the fin units 56 and the hydrofoil 54A.

Figure 17:
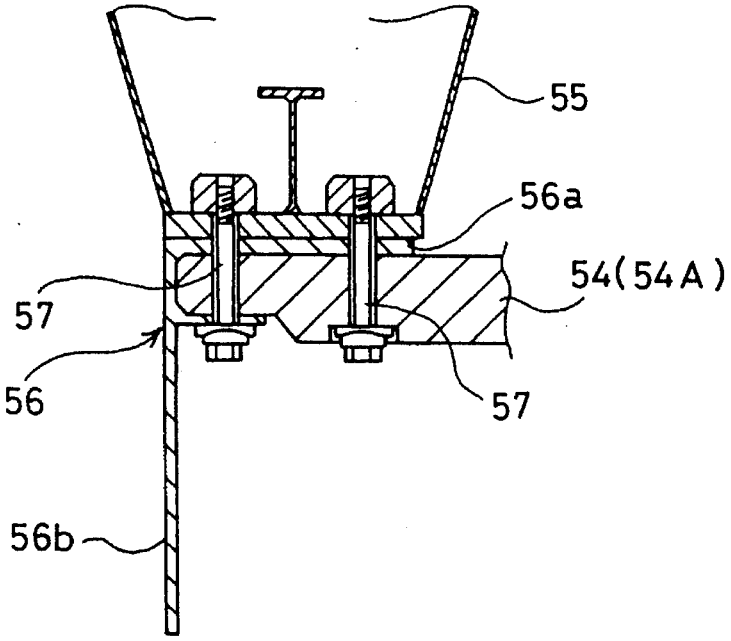
FIG. 17 is a cross-sectional view of fundamental components of a variant of the fin unit according to the third embodiment of the invention.

Incidentally, according to the third embodiment, the fin units 56 are respectively disposed such that the main fin unit 56*b* extends downwardly from the center of the fixing flange 56*a*. However, in place of this arrangement, as shown in FIG. 17 for example, the main fin unit 56*b* may extend downwardly from the right side or the left side of the fixing flange 56*a*.

According to the foregoing embodiments, the fin units are respectively secured to the twin-hull by corresponding struts. However, instead of this, the fin units may directly be secured to the bottom domain of the twin hull.

What is claimed is:

1. A twin-hull boat comprising two laterally spaced apart longitudinally extending hull structures with a longitudinal center line of the twin-hull boat between the two hull structures and having stem and stern hydrofoils extending between the two hull structures and wherein each of said hull structures has an internal wall facing the center line, comprising:

a pair of auxiliary wings each having a proximal end and a distal end secured at a position in front of said stem and stern hydrofoils, said positions of the auxiliary wings being such that they are submerged under water in the course of low-speed cruising below an upper water line which is defined as the water line when the boat is cruising at a first relatively low speed and come up out of the water in the course of accelerating to high-speed cruising above an upper water line which is defined as the water line when the boat is cruising at a second relatively high speed in excess of the first speed, the proximal end of said auxiliary wings being fixed to the internal walls of said respective hull structures, the distal ends of said auxiliary wings being projected toward the center line of said twin hull; and a postural angle regulating device for properly regulating the postural angle of said auxiliary wings by causing said auxiliary wings to respectively pivot on a horizontal axis perpendicular to the length of said twin hull.

* * * * *